US010239726B2

(12) United States Patent
Bravin

(10) Patent No.: US 10,239,726 B2
(45) Date of Patent: Mar. 26, 2019

(54) RIBBON SELF-ORIENTING DEVICE FOR TRAVERSED ROLLS

(71) Applicant: Dynamex Corporation, Carson, CA (US)

(72) Inventor: Ben Bravin, Los Angeles, CA (US)

(73) Assignee: DYNAMEX CORPORATION, Carson, CA (US)

( * ) Notice: Subject to any disclaimer, the term of this patent is extended or adjusted under 35 U.S.C. 154(b) by 248 days.

(21) Appl. No.: 15/183,676

(22) Filed: Jun. 15, 2016

(65) Prior Publication Data

US 2017/0362049 A1 Dec. 21, 2017

(51) Int. Cl.

| | |
|---|---|
| ***B65H 59/10*** | (2006.01) |
| ***B65H 49/18*** | (2006.01) |
| ***B65H 51/32*** | (2006.01) |
| ***B65H 57/00*** | (2006.01) |

(52) U.S. Cl.

CPC ..... *B65H 59/10* (2013.01); *B65H 49/18* (2013.01); *B65H 51/32* (2013.01); *B65H 57/00* (2013.01)

(58) Field of Classification Search

CPC ..... B65H 59/10; B65H 57/00; B65H 49/18; B65H 51/32

See application file for complete search history.

(56) References Cited

U.S. PATENT DOCUMENTS

| | | | | |
|---|---|---|---|---|
| 1,657,308 | A | 1/1928 | Jespersen | |
| 1,867,596 | A | 7/1932 | Roseman | |
| 2,254,220 | A | 9/1941 | Hubbard | |
| 2,453,184 | A | 11/1948 | Berry | |
| 3,080,128 | A | 3/1963 | Hauer | |
| 3,289,956 | A | 12/1966 | Sjogren | |
| 3,677,484 | A | 7/1972 | Yazawa et al. | |
| 3,722,827 | A | 3/1973 | Hrescak | |
| 3,902,701 | A | 9/1975 | Orme | |
| 3,997,122 | A * | 12/1976 | Helfand | B65H 54/026 242/159 |
| 4,015,798 | A | 4/1977 | Benya | |
| 4,139,166 | A | 2/1979 | Powell et al. | |
| 4,232,838 | A | 11/1980 | Bravin | |
| 4,413,792 | A | 11/1983 | O'Connor | |
| 4,489,901 | A | 12/1984 | Andersen | |

(Continued)

FOREIGN PATENT DOCUMENTS

| | | |
|---|---|---|
| DE | 29811053 | 9/1998 |
| EP | 0086096 | 8/1983 |

(Continued)

*Primary Examiner* — Sang K Kim

(74) *Attorney, Agent, or Firm* — Womble Bond Dickinson (US) LLP

(57) ABSTRACT

A ribbon self-orienting device that is to be interposed between the source and the target of a traveling ribbon, either during winding of a ribbon into a traversed roll or during pay-off of a ribbon from a traversed roll. A pivoting frame is pivotally coupled to a frame support, at a pivot axis. First and second direction changing means coupled to the pivoting frame serve to change the direction of the traveling ribbon. A force transfer means transfers a transversely directed force, imparted by the traveling ribbon due to the ribbon traversing its traversed roll while under tension, to the pivoting frame causing the pivoting frame to move about the pivot axis. Other embodiments are also described.

23 Claims, 8 Drawing Sheets

(56) References Cited

U.S. PATENT DOCUMENTS

| | | | |
|---|---|---|---|
| 4,603,817 | A | 8/1986 | O'Connor |
| 4,759,511 | A | 7/1988 | Kuhlmann et al. |
| 4,989,799 | A | 2/1991 | Nakai et al. |
| 5,116,043 | A | 5/1992 | Jermann et al. |
| 5,236,140 | A | 8/1993 | Hirschmann |
| 5,256,232 | A | 10/1993 | Fuss et al. |
| 5,487,255 | A | 1/1996 | Soderberg |
| 5,499,776 | A | 3/1996 | Nojiri et al. |
| 6,062,507 | A | 5/2000 | Summey, III |
| 6,227,731 | B1 | 5/2001 | Kralles et al. |
| 6,450,438 | B1 | 9/2002 | McAllister et al. |
| 6,626,813 | B1 | 9/2003 | Ratzel et al. |
| 7,014,139 | B2 | 3/2006 | Schanke et al. |
| 7,585,444 | B2 | 9/2009 | Baranowske, III et al. |
| 8,052,412 | B2 | 11/2011 | Bateman et al. |
| 8,757,533 | B2 | 6/2014 | Baggot et al. |
| 2011/0248112 | A1 | 10/2011 | Corbett et al. |

FOREIGN PATENT DOCUMENTS

| | | |
|---|---|---|
| EP | 2727865 | 5/2014 |
| WO | WO-2002026608 | 4/2002 |

* cited by examiner

RIBBON SELF-ORIENTING DEVICE FOR TRAVERSED ROLLS

FIELD

An embodiment of the invention relates to a mechanical device that serves to automatically reorient a ribbon that is being unwound from a traversed roll so as to maintain the ribbon, upon its departure from the roll, perpendicular to a rotation axis of the roll as projected onto the outside surface of the roll where the ribbon is about to exit the roll. Other embodiments are also described including ones that are part of a pay-off or take-up system.

BACKGROUND

A supply of ribbon often comes wound in the form of a traversed roll, rather than a flat roll (flat or pancake-type pad.) As seen in FIG. 2, to form a traversed roll 6, for example on a spool 2, is used that is several times "wider" than the width of a ribbon 4. This enables the ribbon 4 to be wound around the spool 2, while moving back and forth along the width of the spool 2, which enables the total length of ribbon 4 that is wound, onto the same diameter spool, to be greater. However, unwinding the ribbon 4 from the traversed roll 6 onto a stationary ribbon guide 8 or other take-up point presents a problem. To explain, assume that the stationary ribbon guide 8 is aligned with a center or midpoint axis of the roll 6 as shown in the drawing (noting that a different position for the stationary ribbon guide 8 will not alleviate the problem.) In that case, as the ribbon 4 is unwound and departs or exits from the roll 6 at the midpoint, it is not unevenly pulled or distorted because the longitudinal axis of the ribbon 4, at that position, is perpendicular to the outside surface of the roll 6. Viewed differently, the longitudinal axis of the ribbon 4, when it has just departed the roll 6 is perpendicular to a rotation axis 10 of the roll 6 as projected onto the outside surface of the roll 6 where the ribbon 4 is about to exit the roll 6.

However, as the departure point of the ribbon 4 traverses towards either the left end or the right end of the roll 6, and then changes direction and traverses back, it is pulled at an increasingly acute angle and may therefore be damaged. That is because an "exit" angle 11 between the longitudinal axis of the ribbon 4 (at the point where it has just departed the roll 4) and the outside surface of the roll 6 is now acute, as shown. The wider the roll 6, the farther away from the midpoint are the left end and the right end of the roll 6, and the more acute the angle 11. If the angle 11 is sufficiently acute, greater damage is imparted on the ribbon 4 (between the roll 6 and the stationary ribbon guide 8.) To alleviate this situation, one solution is to position the stationary ribbon guide 8 farther away from the roll 6, along its center axis. This results in the angle 11 being less acute (when the traversing ribbon 4 reaches either end of the roll 6.) A more complicated solution is to oscillate the roll 6 along its rotation axis to maintain a perpendicular ribbon departure angle at all points of the roll width.

SUMMARY

A ribbon that is moving longitudinally (or traveling) under tension always assumes the shortest available path as it travels from one point to another. This fact is utilized to cause the ribbon, as it assumes the shortest path, to move into (take-up scenario) or out of (pay-off scenario) a traversed roll perpendicularly, at any point along the width of the roll. This is accomplished by passing the ribbon through a specially configured three-dimensional path that causes the ribbon, while assuming the shortest available path, to approach (take-up) or depart (pay-off) a traversed roll perpendicularly. In other words, approaching or departing the traversed roll in any angle other than perpendicular will make the path longer. In most embodiments, this self-orientation of the ribbon in relation to the roll is occurring without application of external power, or location sensing devices.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
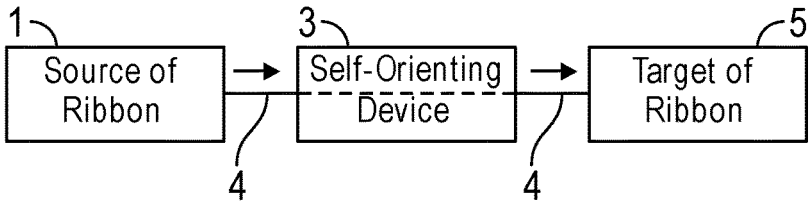
FIG. 1 is a conceptual block diagram of a system in which a ribbon self-orienting device can be used.

FIG. 1 is a conceptual block diagram of a system in which a ribbon self-orienting device 3, in accordance with an embodiment of the invention, can be used. As will be recognized from the description below, one or more embodiments of the self-orienting device 3 provide an elegant solution to the problem of how to reduce the damage that is imparted upon a traveling ribbon that is exiting a traversed roll. The solution may also work to reduce the damage that is imparted upon a traveling ribbon that is being taken up or being wound into a traversed roll. The device 3 is interposed between a source 1 of a traveling ribbon 4, and a target 5 of the traveling ribbon 4. The term "ribbon" is used broadly here, to not just refer to a tape or strip, which is flat but also to other elongated materials such as string, wire, or rope (which are round).

Figure 8B:
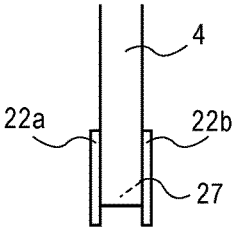
FIG. 8*b* is a close up view, from the top, of a flat roller about which the ribbon is looped, between left and right flanges of the roller.
Figure 8A:
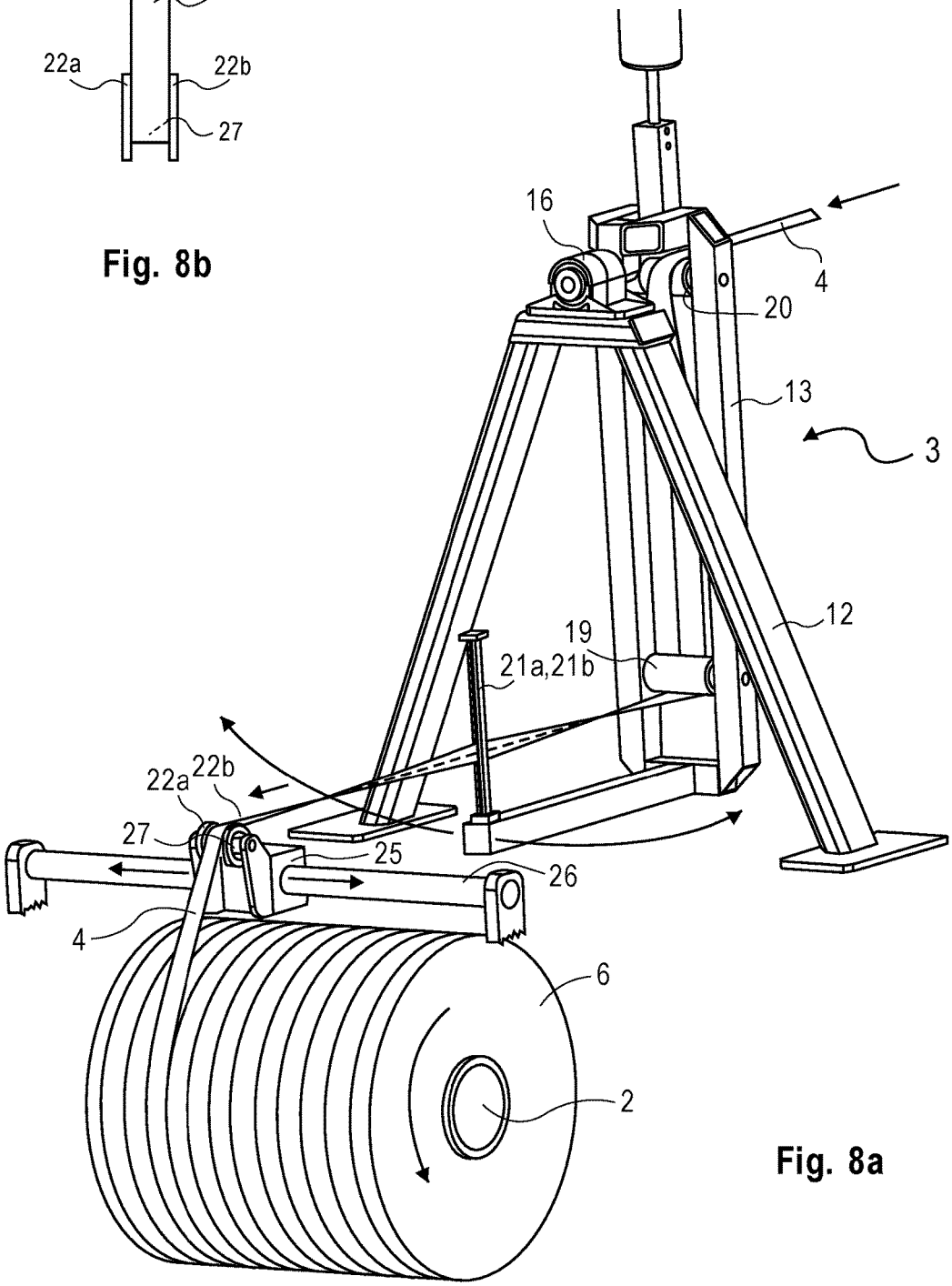
FIG. 8*a* is a view from the front of a ribbon self-orienting device being used in a ribbon take-up system.

In one embodiment, the source 1 may be a machine that is manufacturing the ribbon 4, such as a slitter that is producing multiple metal strips in parallel, or a machine that is producing a polymer tape or strip. The metal strip may be of the type used for manufacturing armored cables, metal clad cables, or flex conduits. The polymer tape may be of the type that is to be used for wrapping around an electrical cable. The target 5 is a ribbon-winding device that is winding the metal or polymer strip into a coil (traverse format), for example onto a spool. The spool is rotatably driven (e.g., motorized) about its rotation axis, such that the traveling ribbon 4 is pulled and emerges from the self-orienting device 3 and is then traverse wound onto the spool to form a traversed roll on the spool. While the traveling ribbon 4 is being wound onto the spool in this manner (so that the diameter of the roll 6 is increasing), the spool (and thus the roll 6) may remain stationary in the direction of its rotation axis (while rotating about its rotation axis.) An example of such a ribbon-winding device is shown in FIG. 8*a* described below.

In another embodiment, the source 1 may be a ribbon pay-off device in which the ribbon 4 has been wound as a traversed roll, and from which the traveling ribbon 4 is unwound by being pulled into the target 5. The traveling ribbon 4 enters the self-orienting device 3 and then exits the device 3 in a single exit plane before entering the target 5. The entry point may be defined as where the ribbon 4 touches a "force transfer means" which is defined further below and may be for example the bars 21*a*, 21*b* depicted conceptually in FIG. 5. The exit point may be defined as where the ribbon 4 leaves a "second direction changing means", again as defined further below and that may be for example the roller 20 conceptually depicted in FIG. 5. The exit plane may be the plane that intersects the stationary ribbon guide 8 and the pivot axis 14, where if the latter is coaxial with the center axis of the traversed roll 6 as depicted in the top view of FIG. 5 then the resulting clockwise and counterclockwise twists of the ribbon 4 (about its longitudinal or travel axis) may be kept to a minimum. The twists are temporary in that the ribbon 4 will be untwisted by the time it has reached the target (e.g., the stationary ribbon guide 8.) The target 5 in this case may be a ribbon-wrapping device that wraps the traveling ribbon 4 over a cable or into a helical shield longitudinally in the process of manufacturing the cable, to form for example an armored cable, the electromagnetic shielding of an electronic cable, a flexible metal conduit, or other electrical cable. While the traveling ribbon 4 is being unwound or paid off from the spool (of the source 1) in this manner, the spool may remain stationary in the direction of its rotation axis (while rotating about its rotation axis.) An example of such a ribbon pay-off device is shown in FIG. 3 described below.

Figure 2:
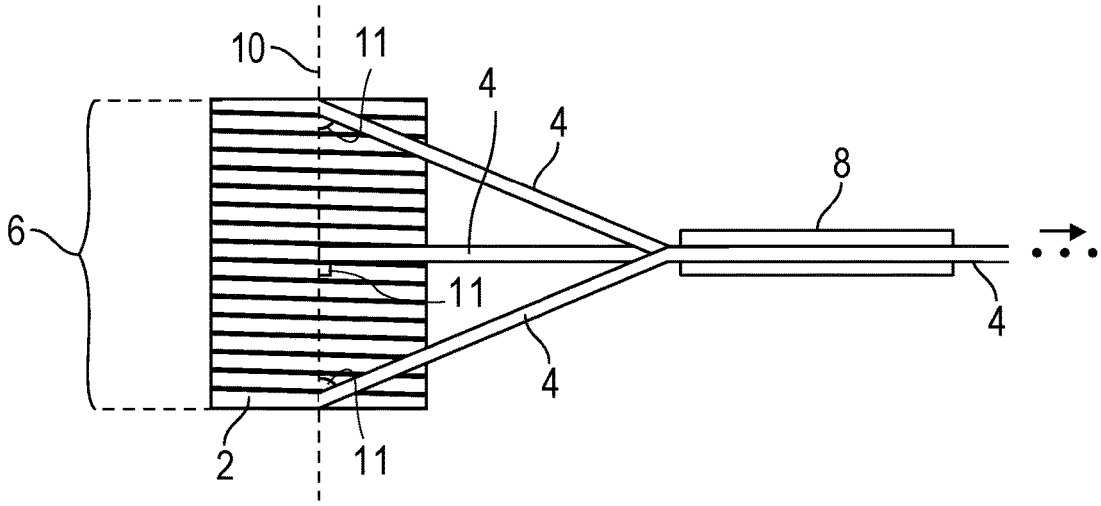
Fig. 2 (Prior Art)
FIG. 2 depicts a conventional ribbon pay-off system in which a ribbon self-orienting device is not being used.

FIG. 2 depicts a conventional ribbon pay-off system in which a ribbon self-orienting device is not being used. The traveling ribbon 4 is unwound from a traversed roll 6 that has been previously formed around a spool 2. The term spool is used broadly here, to refer to not just a conventional spool but also a bobbin, or a reel. The latter is rotatable about its rotation axis 10, enabling the ribbon 4 to be unwound before the ribbon travels through or loops around a stationary ribbon guide 8. There may be a downstream pinch roller (not shown), downstream of the stationary ribbon guide 8, which pulls (in the direction of the arrow) on a downstream portion of the ribbon 4, while an oppositely directed force simultaneously pulls on an upstream portion of the ribbon 4 that is in the roll 6. The latter force may be produced by a brake acting on the spool 2, so as to maintain the ribbon 4 taut or under tension as shown (during the entire pay-off process.)

As seen in FIG. 2, at the exit point of the ribbon 4 (from the roll 6), there is an exit angle 11 formed between a travel axis (or longitudinal axis) of the portion of the ribbon 4 that has just exited the roll 6, and the rotation axis 10 of the spool 2 as it is projected onto the outside surface of the roll 6 where the ribbon 4 is about to exit the roll 4. In this example, the stationary ribbon guide 8 is aligned with the center axis of the roll 6 so as to limit the acuteness of the angle 11 (which as explained above in the Background leads to undesirable damage or uneven stretching of the ribbon 4.) When the ribbon 4 is exiting the roll 6 at the left traverse end or at the right traverse end of the roll 6, the angle 11 is acute, but when the ribbon 4 is exiting at the midpoint or center axis of the roll 6, the angle 11 is a right angle (90 degrees). It is desirable to keep the angle 11 at 90 degrees at all times, during the entire traversing path of the ribbon 4. In accordance with an embodiment of the invention, the ribbon self-orienting device 3 (see FIG. 1) is inserted between the roll 6 and the stationary ribbon guide 8, and serves to cause the ribbon 4 to exit perpendicularly at all points from the roll 6 while simultaneously causing the ribbon 4 to then exit the self-orienting device 3 in a single exit plane, as the ribbon 4 would if it were being paid off from a flat roll (or pancake-type pad.)

Figure 3:
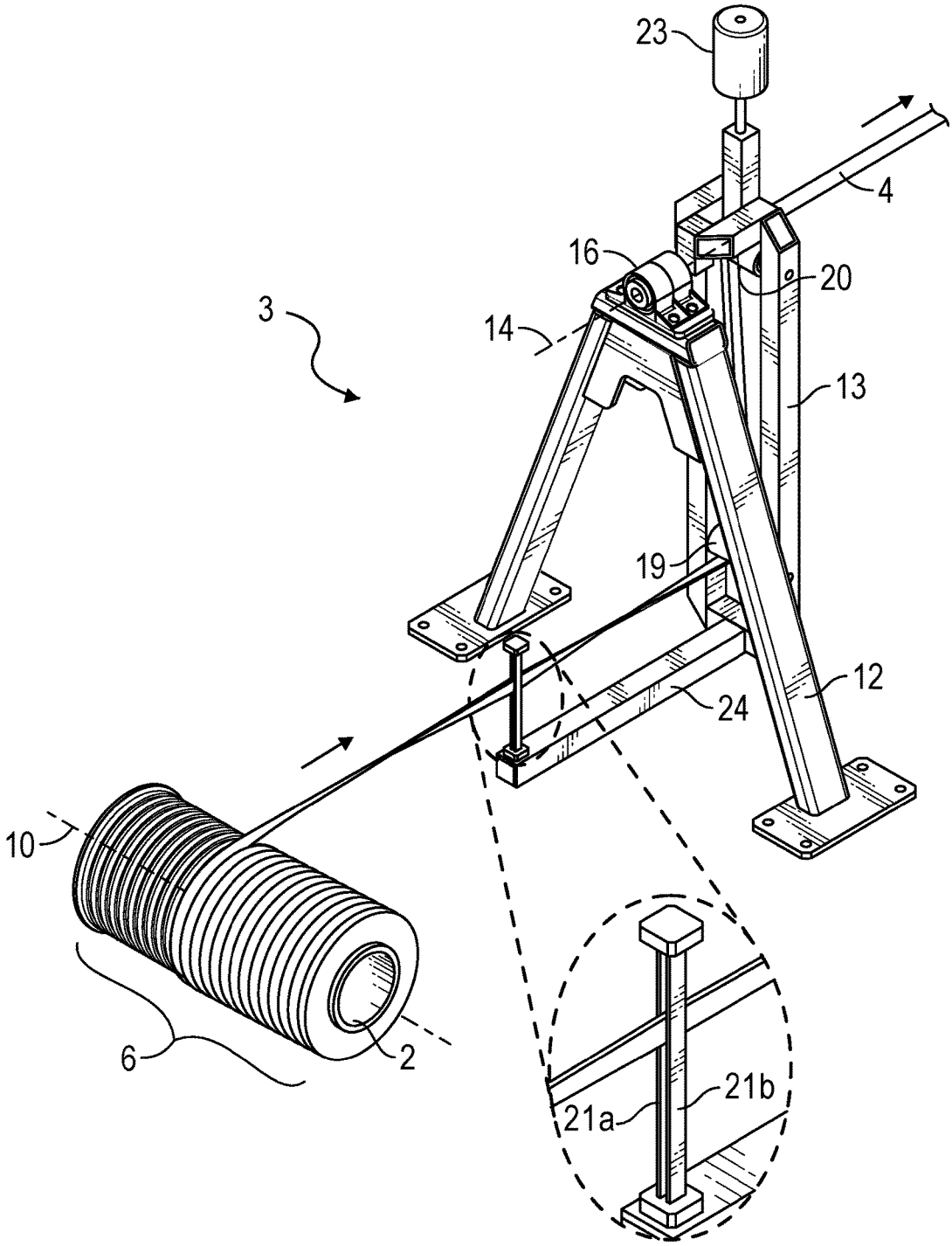
FIG. 3 is a view from the front of a ribbon self-orienting device being used in a ribbon pay off system.
Figure 4:
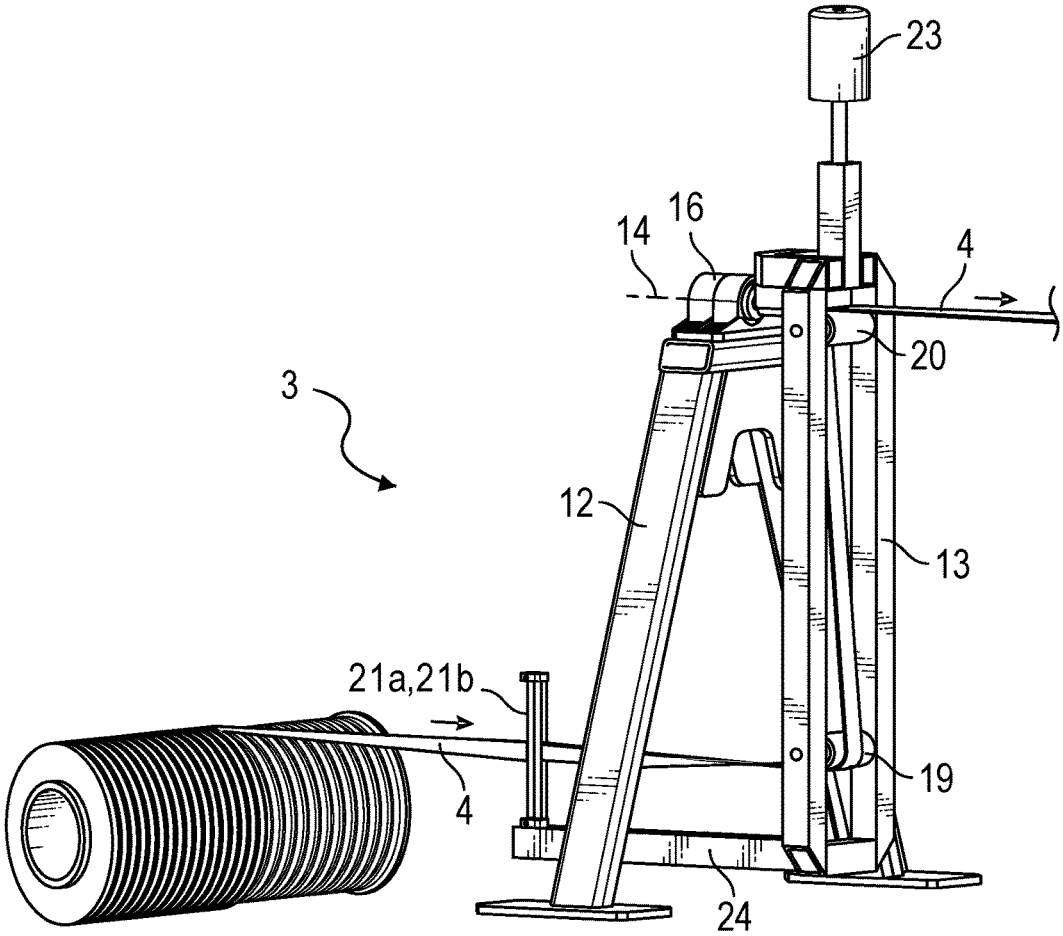
FIG. 4 is a view from the rear of the system in FIG. 3.
Figure 5:
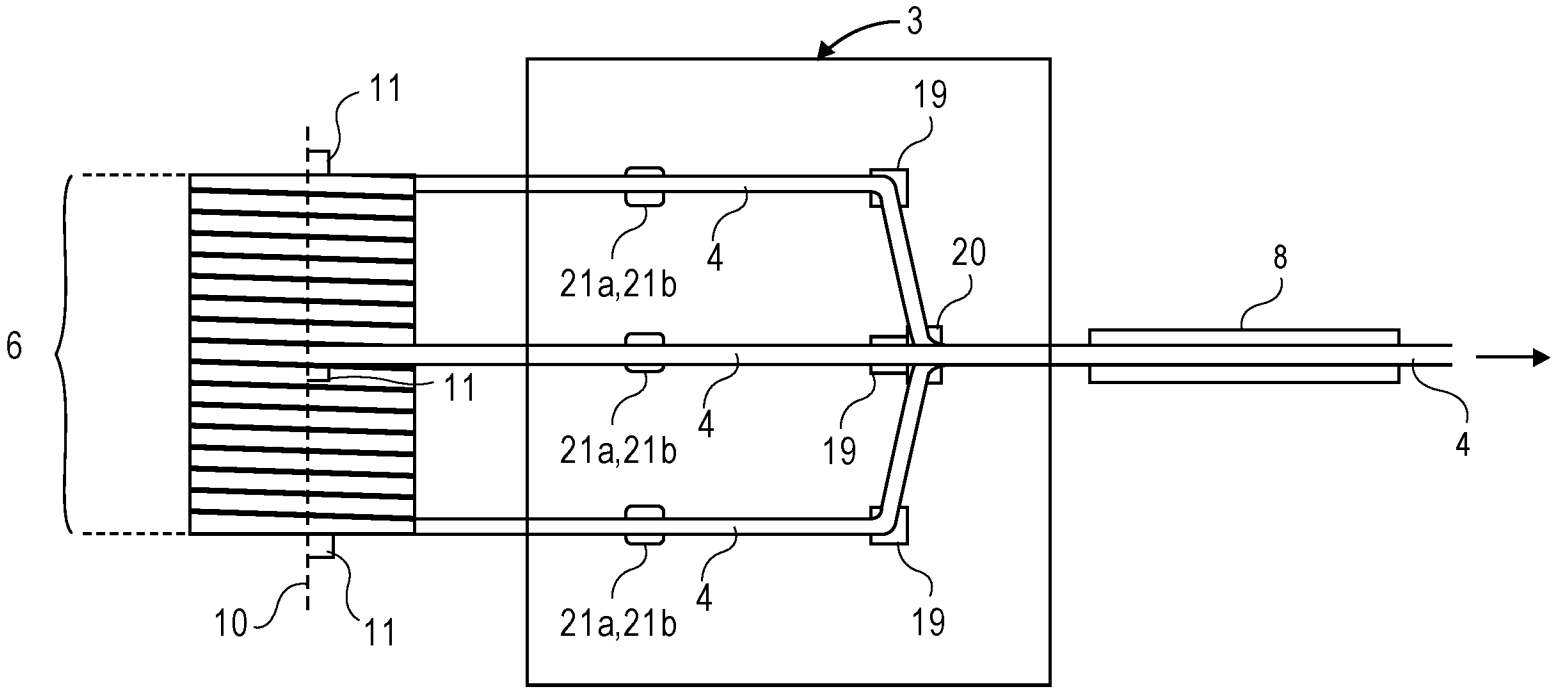
FIG. 5 is a conceptual view of the system in FIG. 3 looking downward from above.

FIG. 3 is a view (from the front) of an embodiment of the ribbon self-orienting device 3. The device 3 is interposed between the source (which includes the traversed roll 6 on the spool 2) and the target of the traveling ribbon 4. This is during pay-off of the ribbon 4, from the traversed roll 6 as the ribbon 4 is being unwound from the traversed roll 6. FIG. 4 is a rear view of the embodiment of FIG. 3, while FIG. 5 is a conceptual view of the system in FIG. 3 looking downward from above. Not shown is the stationary ribbon guide 8 of FIG. 2, which would be positioned just downstream (in the direction of the arrow) of the device 3. The self-orienting device 3 has a frame support 12, shown in this example as an A-frame whose feet can be fastened to the ground or to an object that is heavier than the self-orienting device 3. The frame support 12 supports a pivot axis 14 (in this example at the intersection of the two legs of the A-frame) and a pivoting frame 13 above the ground, so that the pivoting frame 12 can pivot (while the frame support 12 may stay stationary.) Other implementations of the frame support 12 are possible including a box frame or other chassis, frame or support structure that provides clearance for the full stroke of the pivoting frame 13 as it re-orients the ribbon 4 that is traveling through the device 3. The pivoting frame 13 is pivotally coupled to the frame support 12 at the pivot axis 14, by for example having its axle journal held in a bearing 16, the latter being affixed to the frame support 12. The pivoting frame 13 may be described as being "freely pivoting" in that it has the ability to pivot about its pivot axis 14 without being directly driven by gears, or without being driven by a separate motor (separate from any motor that may be driving or braking the spool 2.) The stroke of the pivoting frame 13 is defined by the width of the roll 6. Note that the locations of the axle journal and the bearing 16, on the pivoting frame 13 and on the frame support 12, respectively, may be reversed. Also, the pivoting frame 13 pivots in a plane that is normal (perpendicular) to the entry travel axis of the ribbon 4, the exit travel axis of ribbon 4, and the pivot axis 14. In one embodiment, the terms "normal", "perpendicular", "parallel" and "coaxial" do not mean exactly so but rather nearly normal, nearly perpendicular, nearly parallel or nearly coaxial, which allow a deviation from the exact. Thus, in one embodiment, normal or perpendicular means 90 degrees+/−5%, while in another embodiment it means 90 degrees+/−10%; and parallel or coaxial means having a relative angle of zero degrees+/−ten degrees. The self-orienting device 3, by maintaining such angles, helps reduce the possibility of damage to the ribbon 4 as the latter travels through the self-orienting device 3. Note however that the device 3 as a whole may be oriented differently than shown in FIG. 3 so long as the pivot axis 14 is parallel to the entry and exit travel axes of the ribbon 4.

In the example shown in FIGS. 3, 4, the pivoting frame 12 is composed of at least one arm having a left segment and a right segment that are joined to each other at two points. One end of the arm is positioned farther from the pivot axis 14 than the other. Other implementations of the pivoting frame 12 than the ones shown in the figures here are possible, including a single arm, a curved (rather than straight) arm, and a deviating arm having multiple segments joined to each other at different angles. A first roller 19 is coupled to the arm at one end, and a second roller 20 is coupled to the arm at another end (closer to the pivot axis 14). A roller has two ends between which a generally cylindrical body is held axially so as to freely rotate on a rotation axle; the cylindrical body may be flat or it may be grooved; a roller may be flangeless (as shown in the examples of rollers 19, 20 in FIGS. 3, 4), or it may have a left flange 22*a* and a right flange 22*b* at its two ends, respectively, as shown for the example flat roller 27 in FIG. 8*b*. Returning to FIGS. 3, 4, the rollers 19, 20 may be rigidly coupled to the arm so as to move as one with the pivoting frame 13 (about the pivot axis 14.) For example, the rotation axle (also referred to here as rotation shaft) of each roller 19, 20 can be held at either of its ends by a respective one of the left and right segments of the arm, as shown, also serving to join the left and right arm segments at those two points. Each roller 19, 20 may be a flat roller, or it may be a grooved roller; a roller may also have left and right flanges (not shown) affixed at its opposing ends, between which the ribbon 4 is looped around or guided by the body of the roller. The rollers 19, 20 are examples of first and second direction changing means, respectively, which serve to change the travel direction of the traveling ribbon 4, where the ribbon 4 is looped around or guided by each of the rollers 19, 20, and where the rollers 19, 20 are stationary in their orientation relative to the pivoting frame 13. Note that in the pay-off embodiments, e.g., FIGS. 3, 4, the ribbon 4 travels through the device 3 by traveling around the first direction changing means before it travels around the second direction changing means; in the take-up embodiments, the ribbon travel direction is reversed so that the ribbon 4 travels around the second direction changing means before the first direction changing means, see, e.g., FIG. 8*a* described below.

In the embodiment depicted in FIGS. 3, 4, the second roller 20 is positioned relative to the pivot axis 14 so that a travel axis (longitudinal axis) of a portion of the ribbon 4 that extends between the second roller 20 and the downstream target (not shown) of the ribbon 4, is aligned with the pivot axis 14, as shown. This ensures that the portion of the ribbon 4 which exits the self-orienting device 3 (and extends from the second roller 20 to the stationary ribbon guide 8—see FIG. 1) remains within a single exit plane (that contains the pivot axis 14, the longitudinal axis of the ribbon 4, and the stationary ribbon guide 8), during the entire pivoting range of the pivot frame 13. This helps reduce the damage that is imparted upon that portion of the ribbon 4, to just a clockwise and counterclockwise (back and forth) temporary twist of that portion of the ribbon 4, in an amount that is limited to the angular pivoting range of the pivoting frame 13. Viewed another way, the roller 20 may be positioned on the arm to be "close" to the pivot axis 14 such that the travel axis of the ribbon 4 (which the roller 20 guides to its exit from the self-orienting device 3) is coaxial with the pivot axis 14 (in practice, nearly coaxial as explained above). This may minimize the amount of twist that is imparted upon the ribbon 4 upon its exit from the roller 20 (due to the pivoting movement of the frame 13.) In general, the angular pivot range of the pivoting frame 13 may be dictated by the distance between the left and right traverse ends on the traversed roll 6 (or the width of the roll 6) and by the distance between the roller 20 and the roller 19 (or more generally, the distance between the first and second direction changing means.) Note that the length of the chord of an arc that is defined by the full swing or pivoting of the entry point (in the case of pay-off) or exit point (in the case of take-up) of the ribbon 4 (e.g. at the bars 21*a*, 21*b* which are described below), is a function of (e.g., is essentially) the width of the roll 6.

Still referring to FIGS. 3, 4, the example self-orienting device 3 depicted there has a first bar 21*a* and a second bar 21*b* that are rigidly coupled to the pivoting frame 13 by way of a frame extension member 24 that is rigidly joined to and extends from the two arms. The bars 21*a*, 21*b* are thus stationary in orientation, relative to the extension member 24 and the pivoting frame 13. The term bar is used broadly here, to refer not just to a solid core bar but also a hollow core bar (or tube), and to any elongated structure whose cross section and/or outside surface has a shape that is suitable for guiding or changing the direction of travel of the ribbon 4. The traveling ribbon 4 enters the self-orienting device 3 by passing between the bars 21*a*, 21*b*. The bars 21*a*, 21*b* should be tall enough so that the ribbon 4 remains flat in between them and is preferably not pinched (against the top or bottom end plates that are shown as being joined to the ends of the bars 21*a*, 21*b*), both when pay-off begins (the roll 6 is at its greatest diameter and so the ribbon 4 is traveling at a greater height through the bars) and when pay-off ends (the roll 6 is at its smallest diameter such that the ribbon 4 is traveling at a smaller height through the bars.) The first bar 21*a* is positioned in this example directly across the second bar 21*b*, and is to receive a left directed transverse force from the ribbon 4 while the latter is traversing towards the left end of the roll 6. The second bar 21*b* is positioned to receive a right directed transverse force from the ribbon 4 while the latter is traversing towards the right end of the roll 6. In other words, the bars 21*a*, 21*b* together serve to capture both of the oppositely directed, traverse forces imparted by the traveling ribbon 4 due to the ribbon traversing its traversed roll 6 while under tension, which are converted into the pivoting movements of the pivoting frame 13. The bars 21*a*, 21*b* thus serve to transfer oppositely directed (left direction and right direction), transverse-directed forces, which are imparted by the traveling ribbon 4 due to the ribbon 4 traversing its traversed roll 6 while under tension, to the pivoting frame 13. To improve the accuracy of the self-orienting device 3 in terms of maintaining the angle 11 as close to 90 degrees as possible at the point where the ribbon 4 transitions between its leftward traverse to its rightward traverse (as well as at the other end, between its rightward traverse to its leftward traverse) the spacing between the bars 21*a*, 21*b* (as they are positioned so that a width face of the left bar touches the left width side of the traveling ribbon when the ribbon is traversing to the left, and a width face of the right bar touches only the right width side of the traveling ribbon when the ribbon is traversing to the right), should be kept to a minimum that allow just enough room for the ribbon to pass freely there between, as shown. The bars 21*a*, 21*b*, or alternatively a pair of rollers, or the combination of one roller and one bar, as they are affixed to the pivoting frame 13 are thus an example of a "force transfer means" which causes the pivoting frame 14 to move (pivot) about the pivot axis 14 in both directions, as the ribbon 4 traverses between the left and right traverse end points of the roll 6.

As seen in the conceptual, top view of FIG. 5, the mechanism of the self-orienting device 3 described above in connection with FIGS. 3, 4 results in the exit angle 11 being maintained at essentially 90 degrees across the entire traverse path of the ribbon 4 (while unwinding the ribbon 4 or paying off the ribbon 4 from the traversed roll 6.) The exit angle 11 being referred to here is the angle formed between i) the longitudinal axis or travel axis of the portion of the ribbon 4 that has just exited the roll 6 (the exit travel axis), and ii) the outside surface of the roll 6. The three instances of the angle 11 are depicted in FIG. 5 by the three right angle symbols, corresponding to the ribbon 4 exiting the roll 6 at three positions, namely the midpoint, the left traverse end, and the right traverse end. Note how the second roller 20 remains in the pivot plane (and is also aligned with the stationary ribbon guide 8 in the exit plane), while the first roller 19 moves up and down in the pivot plane in lock step with the bars 21*a*, 21*b* between the left and right traverse end positions. The ribbon 4 exits the device 3 in the single, exit plane, as the ribbon 4 would if it were being paid off from a flat or pancake-type roll (rather than the traversed roll 6), while remaining perpendicular to the outside surface of the traversed roll 6 at all times. Contrast this with the conventional approach depicted in FIG. 2 where the angle 11 becomes acute at the left and right traverse ends. Note however that FIG. 5 does not show the twist (about the travel axis) that is imparted upon the ribbon 4 both upon its exit from and upon its entry into the device 3, as can be seen in FIGS. 3, 4.

It should also be noted that the benefit of maintaining the exit angle 11 at essentially 90 degrees during pay-off of the ribbon 4 (across the full width of the roll 6) also applies to a take-up embodiment in which the ribbon 4 is being taken up or wound around a spool, to form a traversed roll (e.g., a helical or coil package.) In that case, the angle 11 is referred to as the "entry" travel axis angle at which the ribbon 4 comes into contact with or lands onto the packaged traversed roll 6, or a roller 27 of a traversing carriage as in the example embodiment of FIG. 8*a* described below, and is also kept at essentially ninety degrees during the full range of traversal across the roll 6. The angle 11 is the angle between i) the travel axis of the ribbon 4 and ii) the rotation axis 10 of the roll 6 as projected onto the outside surface of the roll 6 where the ribbon 4 is about to land. This occurs while the roll 6 remains stationary in the direction of its rotation axis 10, and even though the ribbon had entered the self-orienting device 3 at a single point. A take-up embodiment is depicted in FIG. 8*a* described further below, where in that case the angle 11 refers to the angle between i) the travel axis of the ribbon 4 as it is about to land onto the roller 27 and ii) the rotation axis of the roller 27 as projected onto the outside surface of the body of the roller 27.

Returning to FIGS. 3, 4, the "force transfer means" shown as the bars 21*a*, 21*b* may alternatively be the combination of a single bar (or pin) and a single roller that are directly opposite each other. In other words, one of the bars 21*a*, 21*b* would be replaced with a roller whose rotation axle is affixed to the pivoting frame 13, directly opposite and in the same orientation as the longitudinal axis of the other one of the bars 21*a*, 21*b*. In another embodiment, the force transfer means is a pair of rollers that are directly opposite each other (both of their rotation axes are affixed to the pivoting frame 13 directly opposite to each other and in the same orientation as each other, as are the longitudinal axes of the bars 21*a*, 21*b* depicted in FIGS. 3, 4.) In yet another embodiment, the force transfer means is a trio (or more) of rollers whose rotation axles are affixed to the pivoting frame so that they are in the same orientation as each other but are in-line with each other along the travel direction of the ribbon 4 such that the ribbon 4 "snakes" through the three or more rollers in sequence. Also, the bars 21*a*, 21*b* in FIGS. 3, 4 are shown as being flat and their width faces are directly opposite each other, so that the flat or width surfaces of the ribbon 4 push against the flat or width surfaces of the bars 21*a*, 21*b*, respectively. This solution is particularly advantageous when the ribbon 4 is soft; with a soft ribbon, it may not be advisable to use its edge surface or edge side (rather than its width surface or width side) to push against a surface of the force transfer means as doing so may cause damage to the ribbon 4. Compare this to the embodiment of FIG. 7*a* described below, where the ribbon 4 in that case is deemed to be hard, such that its left and right edge surfaces alone can be used to transfer the traverse directed forces to the pivoting frame 13.

Here, it should also be noted that to help improve the "accuracy" of the self-orienting device 3, in the sense of coming closer to maintaining the exit angle 11 at an ideal of 90 degrees at all points along the traverse path, a counterweight 23 may be coupled to the pivoting frame 13 (e.g., at a location that is directly opposite the two arms and across the pivot axis 14, as shown in FIGS. 3, 4.) This makes the pivoting frame 13 balanced about the pivot axis 14, thereby reducing the transverse forces imparted from the traveling ribbon 4 to pivotally move the pivoting frame 13. In other words, adding the counterweight to balance the pivoting frame 13 causes a reduction in the transversely directed force that is required for pivoting the frame 13 and that is "taken" from the traveling ribbon 4 that is under tension, which in turn advantageously reduces the tension required to be present in the traveling ribbon 4 (which is especially useful with soft ribbons.) This optional feature may be more desirable in the embodiments depicted in the figures here, where the support frame 12 and the pivot axis 14 are arranged so that the pivoting frame 13 moves in a plane that is oriented vertically relative to the ground below; in embodiments (not shown) where the support frame 12 and the pivot axis 14 are arranged so that the pivoting frame 13 moves in a horizontal plane (relative to the ground below), the counterweight 23 may not be needed to balance the pivoting frame 13. The term "balanced" here is used to describe the pivoting frame 13 being in equilibrium, at any pivot angle spanning from the left traverse end point to the right traverse end point (of the roll 6.)

Note that in the case of FIGS. 3, 4, the pivoting frame 13 may be described as being "freely pivoting" in that it pivots between the two extremes of (the bars 21*a*, 21*b* being aligned with) the left traverse end point and the right traverse end point of the roll 6, solely due to the transversely directed forces that are imparted by the traversing ribbon 4.

Also note that given the orientation of the bars 21*a*, 21*b* relative to the orientation of the roll 6 or spool 2, as shown in FIGS. 3, 4, a temporary counterclockwise twist of 90 degrees is imparted upon the ribbon 4 as it travels from the roll 6 through the bars 21*a*, 21*b*, and then a temporary clockwise twist of 90 degrees is imparted (undoing the previous twist), as the ribbon travels from the bars 21*a*, 21*a* and is guided around the first roller 19. The severity of these two temporary twists may be balanced and reduced, by adding the frame extension member 24 whose length may be designed to locate the bars 21*a*, 21*b* equidistant between the roll 6 and the first roller 19. In cases where twists are not desirable in view of the material properties of the ribbon 4, the embodiment of FIG. 7*a* described below may be used in which twisting of the ribbon 4 only occurs upon exiting from the second roller 20. That twisting is also limited to the angular pivot range of the pivoting frame 13, which in turn is a function of the width of the roll 6 and the distance between the first and second direction changing means, where the latter here are the roller 19 (with or without the flanges 22*a*, 22*b*) and the roller 20, respectively.

Figure 6:
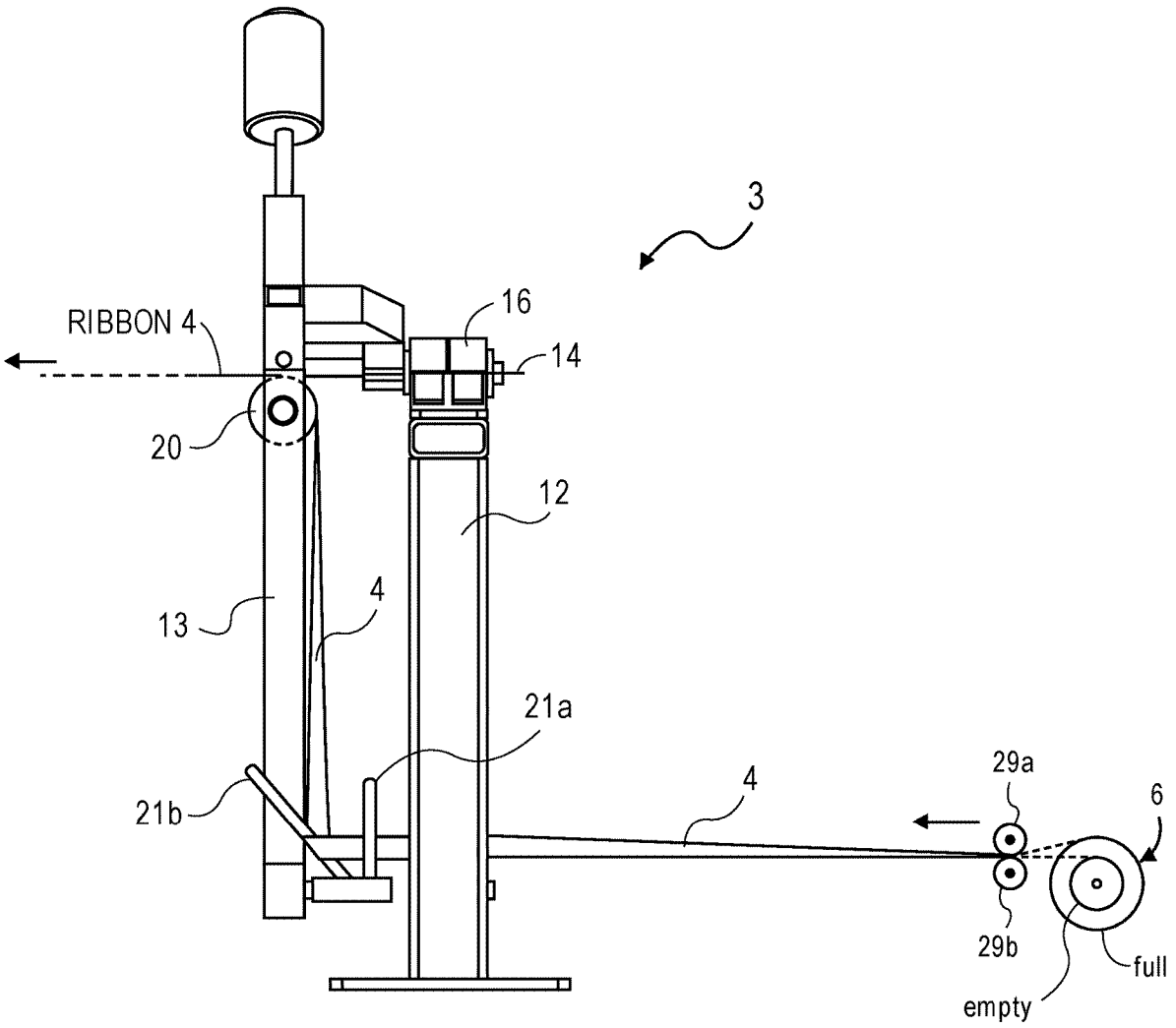
FIG. 6 is a side view of another embodiment of the ribbon self-orienting device.

It should also be noted that maintaining the entry and exit travel axes parallel to the pivot axis 14 is, strictly speaking, only possible for a certain diameter of the roll 6. For example, referring now to FIG. 4, assume that the spool 2 has been set to a height (relative to the self-orienting device 3) such that when the roll 6 is at 50% of its maximum diameter (where at the start of pay-off the diameter of the roll 6 is defined to be at 100% and at the end of pay-off the roll diameter is at 0%) the exit travel axis of the of the ribbon 4 is parallel to the pivot axis 14. This means that exit travel axis is inclined upward, and hence is not exactly parallel with pivot axis 14, at the start of pay-off when the roll 6 is at 100% of max diameter. The exit travel axis is also not exactly parallel with the pivot axis 14 when the roll is at its 0% of max diameter, as it is inclined downward in that case. This deviation from the true parallel as the diameter of the roll 6 changes during pay-off (or during take-up) is considered acceptable in many instances. In the event however such deviation is not acceptable, then a pair of bars, a pair of rollers, or a slot in a plate, all of which may extend the full width of the roll 5, can be added between the source of the ribbon 4 and the entry to the self-orienting device 3, through which the ribbon 4 travels. An example is shown in FIG. 6, as a pair of rollers 29*a*, 29*b* through which or between which the ribbon 4 is fed. The rotation axles of the rollers 29*a*, 29*b* have the same orientation and are in position directly opposite each other, at a fixed height that results in the entry travel axis of the ribbon 4 (here, upon entry into the self-orienting device 3 at the inclined bar 21*b*) being parallel to the exit travel axis of the ribbon 4 (here, upon exit from the self-orienting device 3 when leaving the roller 20), regardless of the changing inclination of the ribbon 4 upstream of the rollers 29*a*, 29*b* that is due to the changing diameter of the roll 6 between its full and empty states, as shown.

Turning now to FIG. 6, a side view of another embodiment of the ribbon self-orienting device 3 is shown. A salient difference between this embodiment and that of FIGS. 3, 4 is that in FIGS. 3, 4, the force transfer means are the first and second bars 21*a*, 21*b* (as affixed to the pivoting frame 13) which are separate from the first direction changing means being the roller 19. This may help improve the efficiency in transferring the available, transversely directed forces (of the traveling and traversing ribbon 4) to the pivoting frame 13. However, a separate force transfer means is not necessary in all instances. This is the case in FIG. 6, where the force transfer means and the first direction changing means share the second bar 21*b*. In particular, while the longitudinal axis of the second bar 21*b* still lies in a travel plane of the ribbon 4, it is in this case inclined, by for example thirty (30) to sixty (60) degrees, e.g., preferably 45 degrees+/−5 degrees as shown, relative to a travel axis of the ribbon 4. This allows the second bar 21*b* by itself to perform a transverse-directed force transfer, while the ribbon 4 is moving (traversing) both to the left and to the right. In addition to capturing the left directed and right directed transverse forces of the traveling ribbon 4, the inclined second bar 21*b* by itself also changes the travel direction of the ribbon 4 (towards the roller 20.) The ribbon 4 is guided by only partially wrapping around the second bar 21*b* as shown, and because of the inclination of the second bar 21*b* changes direction as shown, and then continues on to and around the second roller 20 (before at that point exiting the self-orienting device 3.) The latter means that in this embodiment, the roller 19 is not needed to perform the direction change. In fact, this modification (eliminating the roller 19) can also be made to the embodiment of FIGS. 3, 4, by replacing the roller 19 with the bar 21*b* but inclined by for example 30 to 60 degrees relative to a travel axis of the ribbon 4. To fulfill its goal of producing a smoother direction change, both in the embodiment of FIG. 6 and also in the modification to the embodiment of FIGS. 3, 4 (where the roller 19 is replaced with the second bar 21*b* as inclined) the second bar 21*b* is rounded as compared to the unmodified embodiment of FIGS. 3, 4. More generally for the first and second direction changing means, any bar or roller used in such means may have a smooth and rounded body against which the traveling ribbon 4 comes into contact (and about which the travel axis of the ribbon 4 changes direction.) Note however that the use of a bar may increase the friction that is produced against the traveling ribbon 4, as compared to a roller. Such friction may be reduced when the bar is formed as a tube, and the outside body surface of the tube, with which the ribbon 4 comes into contact, has a number of holes are formed therein. When the tube is connected to an air supply, an air bearing is formed on its outside surface where the holes are located, thereby reducing the friction against the guided ribbon 4.

If additional accuracy is desired to maintain the exit angle 11 (see FIG. 5) of the ribbon 4 closer to the ideal of 90 degrees, at all times during the traverse from left end to right end (and back), then the first bar 21*a* should be included (in addition to the second bar 21*b*), as shown in FIG. 6. The addition of the first bar 21*a* in this arrangement assists only in harvesting the left directed transverse force, while the second bar 21*b* by virtue of being inclined can harvest both the left and right directed transverse forces and can also perform a change of direction upon the traveling ribbon 4. In yet another embodiment, a third bar (not shown) may be coupled to the pivoting frame 13, directly across the first bar 21*a* on the opposite side of the ribbon 4, so as to assist in harvesting the right directed transverse force only.

Figure 7A:
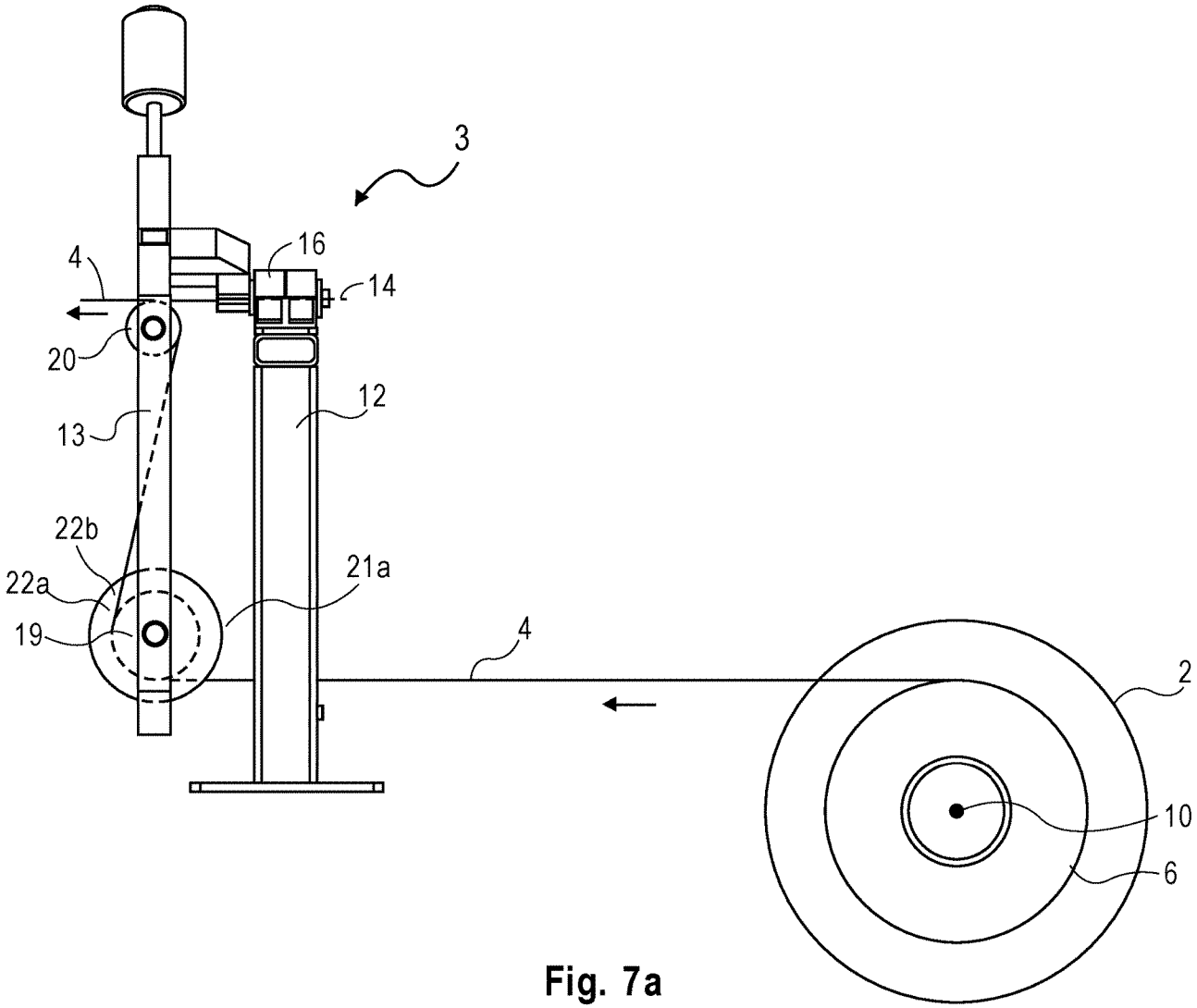
FIG. 7*a* is a side view of yet another embodiment of the ribbon self-orienting device as part of a pay-off system.

In FIG. 7*a*, a side view of yet another embodiment of the ribbon self-orienting device 3 is shown. A salient difference between this embodiment and that of FIGS. 3, 4 is that the force transfer means now shares with the first direction changing means a flanged, flat groove roller, or a grooved pulley or sheave, whose width between its left and right flange surfaces is as wide as the width of the ribbon 4. In other words, a left flange 22*a* and a right flange 22*b* have been added to the opposing ends of the roller 19—see e.g., FIG. 8*b*, which is a top view of a similar arrangement on a flat roller 27. The roller 19 may again be fixed in orientation relative to the pivoting frame 13. The flanges 22*a*, 22*b* serve to trap the ribbon 4 in the lateral or sideways directions, to thereby capture the left and right transversely directed forces, respectively, imparted by the traveling ribbon 4 that is under tension (and transfer those forces to the pivoting frame 13), through the left and right edges of the ribbon 4 (rather than through the left and right faces of the ribbon as in FIGS. 3, 4.) This is another way of using some of the tension that exists in the traveling ribbon 4, to pivot the pivoting frame 13. Another difference between this embodiment and that of FIGS. 3, 4 is that the ribbon 4 is not twisted upon its entry into the self-orienting device 3 (between its exit point on the traversed roll 6 which in this case is on a flanged, spool 2, and its entry at the roller 19.) The ribbon 4 may only be twisted in this case upon its exit from the self-orienting device 3 at the roller 20 (limited to the angular pivot range of the pivoting frame 13.) These features make this embodiment suitable for when the ribbon 4 is hard such that it can impart its transversely directed forces to the pivoting frame 13 through its edge.

Viewed another way, in FIGS. 3, 4, the first and second direction changing means are depicted as rollers 19, 20, respectively, that are coupled to the pivoting frame 13 as spaced apart from each other along the longitudinal or travel direction of the ribbon 4. In addition, a force transfer means is also present on the pivoting frame 13, in that case as a pair of bars 21*a*, 21*b* (or alternatively rollers) that are displaced from the first direction changing means (the roller 19) and oriented so as to induce a twist in the ribbon 4. This version may be more suitable for a soft ribbon. In another embodiment, however, the first direction changing means and the force transfer means share some structure, such as in FIG. 7*a* where the first direction changing means is the roller 19, and the force transfer means is the roller 19 with flanges 22*a*, 22*b* at its opposite ends, respectively (e.g., a flanged, flat groove roller.) As in FIG. 3, the rotation axis of the roller 19 in FIG. 7*a* is perpendicular to the ribbon travel direction at that point. The flange separation is just slightly wider than the ribbon 4, which travels between the flanges 22*a*, 22*b*, as seen for example in the top view depicted in FIG. 8*b* (albeit for a different roller.) An alternative to the flanges 22*a*, 22*b* of FIG. 7*a* is a pair of rollers or a pair of bars (not shown) that are affixed to the pivoting frame 13, having the same orientation and being directly opposite each other and spaced apart by essentially the width of the ribbon 4, e.g., just upstream of the roller 19, with the ribbon 4 traveling between those rollers or bars while the ribbon 4 (through its edges) alternately pushes against one and the other roller or bar (while traversing in one direction and then in the other, across the full width of the roll 6.)

Figure 7B:
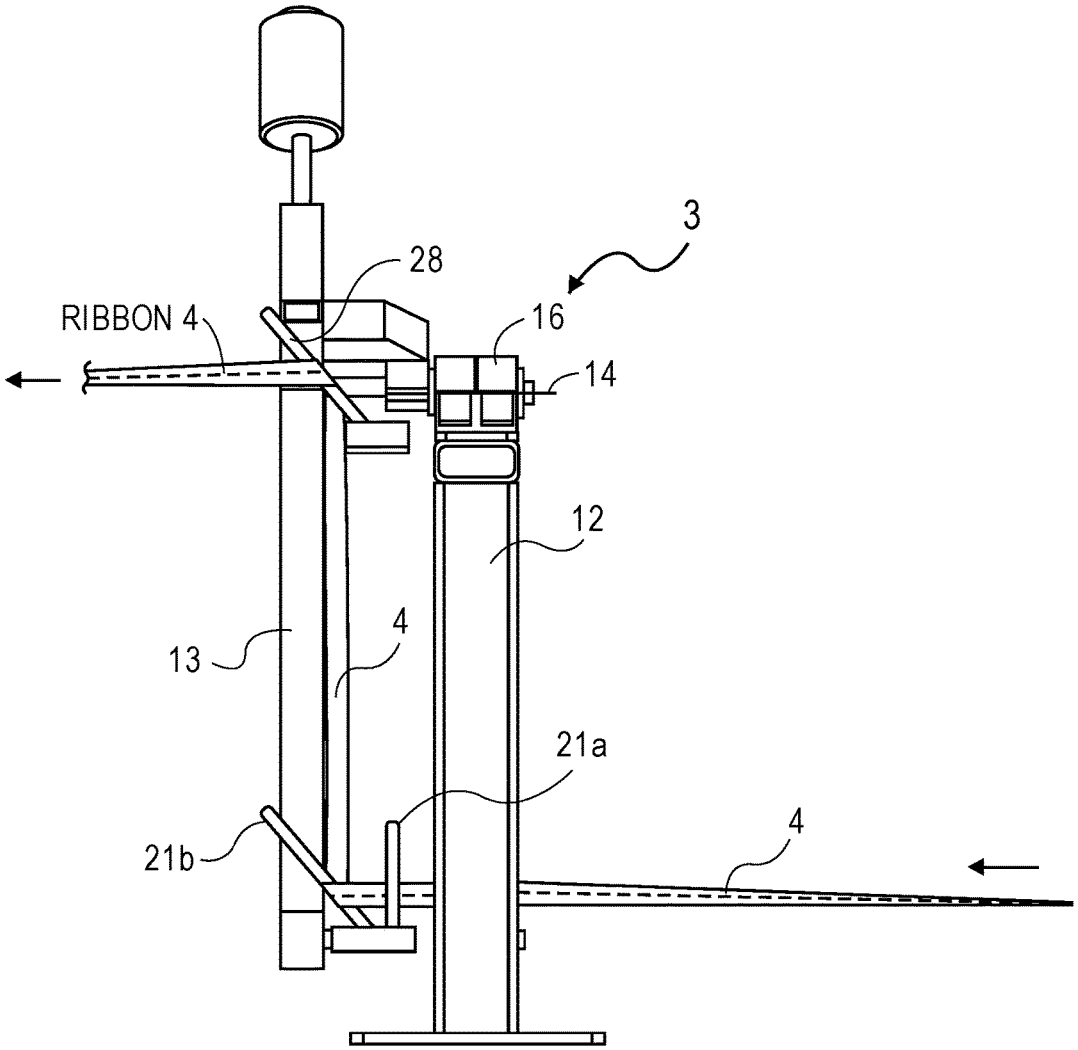
FIG. 7*b* is a side view of yet another embodiment of the ribbon self-orienting device as part of a pay-off system.

Another embodiment of the invention, that may be more suitable for a soft ribbon, rather than a hard ribbon, is depicted in FIG. 7*b*. This is similar to the embodiment of FIG. 6 except that the roller 20 has been replaced with an inclined bar 28 about which the ribbon 4 is partially wrapped as it travels from the inclined bar 21*b* and out of the self-orienting device 3. The inclined bar 28 may be rigidly coupled to the pivoting frame 13 (to maintain a fixed orientation relative thereto) in such a way that it has the same orientation as the inclined bar 21*b*. As such, it may be obtained by essentially duplicating and then translating the inclined bar 21*b* upward along the pivoting frame 13 as shown, to a position that results in the "exit" travel axis of the ribbon 4 being parallel to and aligned with the pivot axis 14 as shown. In this manner, no twisting is imparted upon the portion of the ribbon 4 that runs between the inclined bar 21*b* and the inclined bar 28. Also, the "entry" travel axis of the ribbon 4 remains parallel to both the pivot axis 14 and the exit travel axis of the ribbon 4 (as shown by the respective dotted lines.)

Turning now to FIG. 8*a*, this is a view from the front of the ribbon self-orienting device 3 of FIGS. 3, 4, while being used in a ribbon take-up system (in contrast to the ribbon pay-off system depicted in FIGS. 3, 4.) The spool 2 in this case is part of the "target" of the ribbon 4 (rather than its source in the case of FIG. 3). The target here includes a ribbon-winding device that has a motor (not shown) that is coupled to rotatably drive the spool 2, so as to rotate it in the direction of the curved arrow shown. The traveling ribbon 4 is wound onto the spool 2 and continues to be wound to form the traversed roll 6 as the spool 2 rotates. A traverse guiding means for guiding the ribbon 4 back and forth, from a left traverse end point to a right traverse end point on the spool 2, includes a carriage 25 that is fitted to slide along a slide bar 26 which spans the width of the spool 2. A motorized actuator (not shown) drives the carriage 25 back and forth along the slide bar 26 to traverse the full distance between the left and right traverse end points. This is done while the traveling ribbon 4 loops around a flat roller 27 that is fixed to the carriage 25, so that the traveling ribbon 4 is also traversed while being wound onto the spool 2, to form the traversed roll 6. The flat roller 27 may have flanges 22*a*, 22*b* on its opposing ends as shown in the top view of FIG. 8*b*, to enable the sideways moving carriage 25 to trap the ribbon 4 sideways and pull it back and forth so as to traverse the spool 2.

In the take-up embodiment of FIG. 8*a*, the ribbon 4 enters the self-orienting device 3 in a fixed plane, and then exits the self-orienting device 3 at the bars 21*a*, 21*b* (in contrast to FIG. 3 where the ribbon 4 enters the self-orienting device 3 at that point) and then enters the traverse guiding means by looping or being guided around the roller 27, and then is wound around the spool 2, forming the traversed roll 6. There is a temporary clockwise twist imparted on the ribbon 4 as it exits the roller 19 and enters in between the bars 21*a*, 21*b*, and then an unwinding, counterclockwise twist as the ribbon exits the bars 21*a*, 21*b* and then comes onto the roller 27. Similar to the pay-off scenario in FIG. 3 where the exit angle 11 of the ribbon 4 was kept at 90 degrees, in the take-up scenario of FIG. 8*a* it can be seen that the "entry" angle of the travel axis of the ribbon 4 relative to the rotation axis of the roller 27 is also maintained at 90 degrees, thereby reducing the likelihood of damage that would otherwise be imparted onto the ribbon 4 were the self-orienting device 3 not present. This is a particularly beneficial result where the traversed roll 6 is large and heavy (e.g., the ribbon 4 is of a metallic or similarly heavy material, such as aluminum or steel), and the alternative of moving the spool 2 back and forth along its rotation axis, in a precisely controlled manner in order to obtain a traverse winding of the ribbon 4 onto it, would be an expensive solution. Use of the self-orienting device 3 allows the spool 2 to remain fixed in the direction of its rotation axis, and controlling the traversing position of the carriage 25 (and its roller 27 with the ribbon 4 guided around it) is less expensive than controlling the oscillatory movement of a heavy spool 2 (with the traversed roll 6 on it) along the rotation axis of the spool 2. Also, the approach described here for maintaining the ribbon 4 perpendicular (at its entry onto the traversed roll 6) may also enable a proper, parallel build-up of the ribbon in the traversed roll 6, also referred to as a layer winding, that would conventionally be achieved by oscillating or traversing the spool 2 itself.

The embodiments of the self-orienting device 3 described above may be viewed as a "passive" device, namely not requiring external drive or power. The desired movement of the pivoting frame 13 (that results in the angle 11 of the traveling ribbon 4 being kept at essentially 90 degrees at all points across the width of the traversed roll 6) is caused solely by the transversely directed forces that are harvested by the force transfer means from the traveling ribbon 4 (which is under tension.) In the case of a take-up embodiment, the self-orienting device 3 could be "actively driven" in that the pivoting of the pivoting frame 13 is caused by a motorized driving means (separate from any motor that is used to rotatably drive the spool 2 for take-up or winding.) In such an embodiment, the force transfer means of the passive embodiments described above is not needed and would be replaced with the driving means and its associated electronic or other control system. Other aspects of the passive devices as described above may still be applicable to the active embodiment. The driving means however may need to be part of a control system that continuously determines the entry position of the ribbon 4 at the traversed roll 6, and ensures that the rotational movement of the first direction changing means (e.g. the roller 19) is at the correct linear velocity over the entire range of pivot across the full width of the roll 6. The active embodiments may be implemented as part of a take-up system such as the one in FIG. 8*a*. The driving means may have a linear or angular actuator (not shown) that is loosely coupled to the pivoting frame 13 and pushes and pulls directly on the pivoting frame 13 to effectuate the back and forth traversing that is needed while winding the ribbon 4. It may do so preferably at a point that is closer to the first direction changing means than the second direction changing means, so as to reduce the amount of force needed to pivot the frame 13. The driving means can have a rotary actuator (not shown) that is coupled to rotatably drive (e.g., through gears) the pivoting frame 13, preferably at a point that is closer to the second direction changing means than the first direction changing means (e.g., at or close to the pivot axis 14.)

While certain embodiments have been described above and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while FIGS. 3, 4 depict the self-orienting device 3 as one where the ribbon 4 enters in a travel axis direction that is the same as when the ribbon 4 exits, an alternative arrangement is to reverse how the ribbon 4 enters, so that the ribbon 4 comes onto the roller 19 from the opposite direction than is shown in FIG. 3. In that case, the ribbon 4 would enter in a travel direction that is opposite to when the ribbon 4 exits (the roller 20.) In such an embodiment, the frame extension member 24 would be flipped 180 degrees about the point at which the extension member 24 joins the two arms of the pivoting frame 13, and the traversed roll 6 (spool 2) would be located on the same side of the pivoting frame from which the ribbon 4 exits. In another variation that may be described as an inverted version of FIGS. 3, 4, the pivoting frame 13 is flipped 180 degrees about the pivot axis 14, thereby allowing the ribbon 4 to enter and exit the self-orienting device 3 at a greater height, namely above the pivot axis 14 (rather than below it as shown in FIGS. 3, 4.) More generally, the self-orienting device 3 may be used in any suitable orientation so as to suit the orientation of the traversed roll 6. Also, while FIG. 8*a* is a take-up version of the embodiment of FIGS. 3, 4, a take-up version of the embodiment of FIG. 6 is also possible, as is a take-up version of the embodiments of FIGS. 7*a*, 7*b* and of the other variations described above. The description is thus to be regarded as illustrative instead of limiting.

What is claimed is:

1. A ribbon reorienting device, to be interposed between a source and a target of a traveling ribbon, either during winding of a ribbon into a traversed roll or during pay-off of a ribbon from a traversed roll, the device comprising:

a frame support;

a pivoting frame that is pivotally coupled to the frame support at a pivot axis;

first and second direction changing means for changing direction of the traveling ribbon, wherein the first and second direction changing means are coupled to the pivoting frame with the second direction changing means being closer to the pivot axis than the first direction changing means, and wherein the first and second direction changing means are to move as one with the pivoting frame about the pivot axis; and a force transfer means for transferring a transversely directed force that is imparted by the traveling ribbon due to the ribbon traversing the traversed roll under tension, to the pivoting frame causing the pivoting frame to move about the pivot axis.

2. The device of claim 1 further comprising a counterweight coupled to the pivoting frame so that the pivoting frame is balanced about the pivot axis.

3. The device of claim 1 wherein the pivoting frame pivots in a plane that is normal to a travel axis of the ribbon at an entry into the reorienting device and normal to a travel axis of the ribbon at an exit from the reorienting device.

4. The device of claim 3 wherein the source of the ribbon is a ribbon pay-off device in which the ribbon has been wound as a traversed roll and from which the ribbon is being unwound and then enters the device and then exits the device and then enters the target, and wherein the travel axis of the ribbon at its entry into the device is the longitudinal axis of the ribbon just before the ribbon comes into contact with the first direction changing means.

5. The device of claim 1 wherein the second direction changing means is positioned so that a travel axis of a portion of the ribbon, that extends between the second direction changing means and either a) the target during pay-off of the ribbon from a traversed roll, orb) the source during winding of the ribbon into a traversed roll, is coaxial with the pivot axis.

6. The device of claim 1 in combination with the source of the ribbon and the target of the ribbon, and wherein the transversely directed forces from the force transfer means are the only forces that cause the pivoting frame to pivot.

7. The device of claim 6 wherein the source of the ribbon is a ribbon pay-off device in which the ribbon has been wound as a traversed roll and from which the ribbon is to exit to then enter the device and then exit the device and then enter the target, and wherein the ribbon is to travel through the device around the first direction changing means before the second direction changing means.

8. The device of claim 7 wherein the traversed roll remains stationary in the direction of its rotation axis while rotating about its rotation axis to pay-off the ribbon.

9. The device of claim 6 wherein the target of the ribbon is a ribbon winding device comprising a spool, wherein the ribbon, upon entering the ribbon winding device, is to be wound onto the spool to form the traversed roll on the spool.

10. The device of claim 9 wherein the spool remains stationary in the direction of its rotation axis while rotating about its rotation axis so that the ribbon is wound onto the spool.

11. The device of claim 9 wherein the ribbon winding device comprises traverse guiding means for guiding the ribbon back and forth along the width direction of the spool from a first traverse end point to a second traverse end point on the spool, wherein the ribbon exits the reorienting device, and then enters and then exits the traverse guiding means, and then is wound around the spool forming the traverse roll.

12. The device of claim 1 wherein the force transfer means shares with the first direction changing means a flanged, flat groove roller, or a grooved pulley or sheave, whose width between left and right flange surfaces is as wide as the width of the ribbon.

13. The device of claim 1 wherein the force transfer means comprises:

a first bar or roller that is positioned to receive a transversely directed force, that is imparted by the traveling ribbon due to the ribbon traversing the traversed roll under tension; and a second bar or roller that is positioned to receive a transversely directed force, that is imparted by the traveling ribbon due to the ribbon traversing the traversed roll under tension, in an opposite direction than the transversely directed force received by the first bar or roller.

14. The device of claim 1 wherein the force transfer means and the first direction changing means are spaced apart from each other along the travel path of the ribbon, and wherein the first direction changing means is positioned between the force transfer means and the second direction changing means along a travel path the traveling ribbon.

15. The device of claim 1 wherein the first direction changing means shares with the force transfer means the second bar or roller whose longitudinal axis lies in a travel plane of the ribbon but is inclined by 30 to 60 degrees relative to a travel axis of the ribbon and relative to a longitudinal axis of the first bar or roller.

16. The device of claim 15 further comprising a third bar or roller coupled to the pivoting frame, that is positioned to receive the transversely directed force, that is imparted by the traveling ribbon due to the ribbon traversing its traversed roll under tension, in the opposite direction than the transversely directed force received by the first bar or roller.

17. The device of claim 1 wherein the first direction changing means comprises a first inclined bar, and the second direction changing means comprises a second inclined bar, wherein the first and second inclined bars as coupled to the pivoting frame have the same orientation such that both bars are inclined relative to a travel axis of the ribbon so as to impart a direction change to the travel axis of the ribbon as the ribbon wraps its width side partially around each of the first and second inclined bars.

18. A ribbon reorienting device, to be interposed between a source and a target of a traveling ribbon, either during winding of a ribbon into a traversed roll or during pay-off of a ribbon from the traversed roll, the device comprising:

a frame support;

a pivoting frame that is pivotally coupled to the frame support at a pivot axis;

a first roller or bar and a second roller or bar, both coupled to the pivoting frame such that the second roller or bar is closer to the pivot axis than the first roller or bar; and a force transfer means for transferring a transversely directed force that is imparted by the traveling ribbon due to the ribbon traversing the traversed roll under tension, to the pivoting frame causing the pivoting frame to move about the pivot axis.

19. The device of claim 18 wherein the force transfer means comprises left and right flanges affixed to the first roller at opposing ends of a body thereof and between which the ribbon is guided.

20. The device of claim 18 wherein the force transfer means comprises the first bar, wherein the first bar is inclined relative to a travel axis of the ribbon so as to impart a direction change to a travel axis of the ribbon as the ribbon wraps its width side partially around the first bar.

21. The device of claim 20 wherein the force transfer means further comprises a third roller or bar that is coupled to the pivoting frame so as to touch an opposite width side of the traveling ribbon, that is opposite to the width side that wraps partially around the first bar.

22. The device of claim 18 wherein the force transfer means comprises a left roller or bar affixed to the pivoting frame and a right roller or bar affixed to the pivoting frame and between which the traveling ribbon passes, so that a body or width face of the left roller or bar touches only the left width side of the traveling ribbon when the ribbon is traversing to the left, and a body or width face of the right roller or bar touches only the right width side of the traveling ribbon when the ribbon is traversing to the right.

23. The device of claim 18 wherein the force transfer means comprises a plurality of rollers whose rotation axles are affixed to the pivoting frame so that they are in the same orientation as each other but are in-line with each other along a travel direction of the ribbon, wherein the ribbon is guided by each of the plurality of rollers in sequence.

* * * * *